US012421635B2

(12) United States Patent
Platz et al.

(10) Patent No.: US 12,421,635 B2
(45) Date of Patent: Sep. 23, 2025

(54) COMPRESSION ARTICLE

(71) Applicant: Essity Hygiene and Health Aktiebolag, Gothenburg (SE)

(72) Inventors: Sascha Platz, Kleve (DE); Verena Voss, Hamburg (DE); Joachim Bauer, Hamburg (DE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 18/596,394

(22) Filed: Mar. 5, 2024

(65) Prior Publication Data

US 2024/0207124 A1 Jun. 27, 2024

Related U.S. Application Data

(63) Continuation-in-part of application No. 17/602,797, filed as application No. PCT/EP2019/059506 on Apr.
(Continued)

(30) Foreign Application Priority Data

May 23, 2018 (EP) ..... 18173788

(51) Int. Cl.
*D04B 1/18* (2006.01)
*D04B 1/24* (2006.01)

(52) U.S. Cl.
CPC ..... *D04B 1/18* (2013.01); *D04B 1/24* (2013.01); *D10B 2401/021* (2013.01);
(Continued)

(58) Field of Classification Search
CPC . D04B 1/18; D04B 1/26; D04B 1/123; D10B 2509/028; D10B 2401/022; D10B 2401/021; D10B 2401/028
(Continued)

(56) References Cited

U.S. PATENT DOCUMENTS 869,986 A 11/1907 Scott
1,883,581 A 10/1932 Thornton
(Continued)

FOREIGN PATENT DOCUMENTS

CH 421359 A 9/1966
DE 4204339 A1 8/1993
(Continued)

OTHER PUBLICATIONS

Advertising Brochure; "EquiCrown® Compression Bandages"; Aug. 2014; 6 pages.
(Continued)

*Primary Examiner* — Danny Worrell

(74) *Attorney, Agent, or Firm* — CANTOR COLBURN LLP

(57) ABSTRACT

A compression article and method for its production on a knitting machine, in particular a flat-bed knitting machine, wherein, in the compression article, respectively the number of stitches per stitch row is matched to the radial circumference of the body part to be treated by the compression article, and which compression article has a plurality of points which are distributed over its circumference and at which, in a stitch row, a stitch increase and/or a stitch reduction is realized, and wherein, moreover, the number of stitches in the wale direction varies over the circumference of the compression article and is matched, in the longitudinal direction of the body part, to the shape of the body part to be treated.

20 Claims, 4 Drawing Sheets

Related U.S. Application Data

12, 2019, now Pat. No. 11,959,205, and a continuation-in-part of application No. 17/057,158, filed as application No. PCT/EP2019/063124 on May 21, 2019, now Pat. No. 11,952,686.

(52) U.S. Cl.
CPC .. *D10B 2401/022* (2013.01); *D10B 2401/061* (2013.01); *D10B 2509/028* (2013.01)

(58) Field of Classification Search
USPC ..... 66/189, 178 A
See application file for complete search history.

(56) References Cited

U.S. PATENT DOCUMENTS

| | | | |
|---|---|---|---|
| 2,203,401 | A | 6/1940 | Barnard |
| 2,574,873 | A | 11/1951 | Conrad |
| 2,841,971 | A | 7/1958 | Bird et al. |
| 3,020,556 | A | 2/1962 | Isley |
| 3,128,475 | A | 4/1964 | Rice |
| 3,889,494 | A | 6/1975 | Patience et al. |
| 3,975,929 | A | 8/1976 | Fregeolle |
| 4,027,667 | A | 6/1977 | Swallow et al. |
| 4,048,818 | A | 9/1977 | Cueman |
| 4,172,456 | A | 10/1979 | Zens |
| 4,180,065 | A | 12/1979 | Bowen |
| 4,502,301 | A | 3/1985 | Swallow et al. |
| 4,527,402 | A | 7/1985 | Swallow et al. |
| 5,388,050 | A | 2/1995 | Inoue et al. |
| D380,073 | S | 6/1997 | Ruszczycki et al. |
| 5,735,145 | A | 4/1998 | Pernick |
| D395,538 | S | 6/1998 | Imboden et al. |
| 5,896,758 | A | 4/1999 | Rock et al. |
| 6,151,922 | A | 11/2000 | Shimasaki |
| 6,427,493 | B1 | 8/2002 | Kasdan et al. |
| D473,694 | S | 4/2003 | Lyden |
| D483,551 | S | 12/2003 | Kallen |
| 6,725,691 | B2 | 4/2004 | Yakopson |
| 7,043,329 | B2 | 5/2006 | Dias et al. |
| D532,958 | S | 12/2006 | Kent |
| 7,360,378 | B2 | 4/2008 | Foshee |
| 7,895,863 | B2 | 3/2011 | Smith et al. |
| 8,317,736 | B2 | 11/2012 | Virkus et al. |
| 9,534,324 | B2 | 1/2017 | Lonati et al. |
| 9,777,413 | B2 | 10/2017 | Messier |
| 9,828,705 | B1 | 11/2017 | Shiue |
| D817,600 | S | 5/2018 | Brown |
| 10,271,581 | B2 | 4/2019 | Kehler et al. |
| 10,273,607 | B2 | 4/2019 | Stein et al. |
| 10,455,868 | B2 | 10/2019 | Duffy et al. |
| 10,645,978 | B2 | 5/2020 | Kehler et al. |
| 10,900,152 | B2 | 1/2021 | Sasaki |
| 10,954,614 | B2 | 3/2021 | Giorgini |
| 11,131,044 | B2 | 9/2021 | Convert et al. |
| 11,134,725 | B2 | 10/2021 | Erkus et al. |
| D960,507 | S | 8/2022 | Baessler et al. |
| 11,560,651 | B2 | 1/2023 | Rock et al. |
| 11,952,686 | B2 * | 4/2024 | Platz ..... D04B 1/265 |
| 11,959,205 | B2 * | 4/2024 | Platz ..... D04B 1/18 |
| 2004/0016043 | A1 | 1/2004 | Uno et al. |
| 2005/0049741 | A1 | 3/2005 | Dias et al. |
| 2007/0033696 | A1 | 2/2007 | Sellier |
| 2010/0130903 | A1 | 5/2010 | Rock |
| 2011/0000005 | A1 | 1/2011 | Brown |
| 2014/0096301 | A1 | 4/2014 | Waller et al. |
| 2016/0076175 | A1 | 3/2016 | Rock et al. |
| 2017/0247822 | A1 | 8/2017 | Atmanspacher |
| 2018/0325188 | A1 | 11/2018 | Burhance et al. |
| 2018/0353345 | A1 | 12/2018 | Sasaki |
| 2020/0385901 | A1 | 12/2020 | Lawrence |
| 2021/0130992 | A1 | 5/2021 | Platz et al. |
| 2022/0154372 | A1 | 5/2022 | Platz et al. |
| 2024/0225909 | A1 | 7/2024 | Voss et al. |

FOREIGN PATENT DOCUMENTS

| | | | |
|---|---|---|---|
| DE | 19616005 | A1 | 10/1997 |
| DE | 20207156 | U1 | 8/2002 |
| DE | 20309726 | U1 | 9/2003 |
| DE | 102006048313 | A1 | 4/2008 |
| DE | 102008031845 | A1 | 1/2010 |
| DE | 102012004150 | A1 | 8/2013 |
| DE | 202010018261 | U1 | 3/2015 |
| DE | 102015115228 | B3 | 9/2016 |
| DE | 202017100286 | U1 | 4/2018 |
| EM | 0085699580005 | | 6/2021 |
| EM | 0085699580006 | | 6/2021 |
| EM | 0085699580008 | | 6/2021 |
| EM | 0085699580010 | | 6/2021 |
| EM | 0085699580012 | | 6/2021 |
| EM | 0085699580014 | | 6/2021 |
| EM | 0085699580016 | | 6/2021 |
| EM | 0085699580018 | | 6/2021 |
| EM | 0085699580020 | | 6/2021 |
| EP | 0522778 | B1 | 8/1997 |
| EP | 0989219 | A2 | 3/2000 |
| EP | 1321551 | A1 | 6/2003 |
| EP | 1621164 | A1 | 2/2006 |
| EP | 2075361 | A1 | 7/2009 |
| EP | 2436276 | A1 | 4/2012 |
| EP | 3085822 | A1 | 10/2016 |
| EP | 3214213 | A1 | 9/2017 |
| EP | 3251641 | A1 | 12/2017 |
| EP | 3572570 | A1 | 11/2019 |
| EP | 3797185 | A1 | 3/2021 |
| WO | 9207128 | A1 | 4/1992 |
| WO | 03040449 | A1 | 5/2003 |
| WO | 2005106087 | A1 | 11/2005 |
| WO | 2006032096 | A1 | 3/2006 |
| WO | 2006064816 | A1 | 6/2006 |
| WO | 2009114899 | A1 | 9/2009 |
| WO | 2010006051 | A1 | 1/2010 |
| WO | 2011005430 | A1 | 1/2011 |
| WO | 2019224204 | A1 | 11/2019 |
| WO | 2020207600 | A1 | 10/2020 |

OTHER PUBLICATIONS

Advertising Brochure; "EquiCrown® Medical Compression Bandages"; Jun. 2013; 2 pages.
Affidavit of Mr. Yusuke Miyaj; Date: Feb. 10, 2023; 2 pages.
Confirmation from the company Shima Seike MFG., Ltd, Japan, regarding the publication of a knitting program 5249W00F for the production of a compression sock; Date: Aug. 17, 2022; 1 page.
Database extract regarding incoming orders and order number for Teccons eK Reisholzstr. 39, 40721 Hilden; Date: Jan. 16, 2014; 1 page.
Delivery confirmation for a compression stocking knitted according to the program Y5249W00F; Date: May 3, 2022; 2 pages.
Delivery Note from Julius Zorn GmbH to Pet Physio c/o MBE Mailboxes ect.; Lieferschein 103401000360; Date: Jan. 16, 2014; 3 pages.
EquiCrown® Price List; Julius Zorn GmbH; May 2014; 1 page.
International Searching Authority, International Preliminary Report on Patentability issued in International Application No. PCT/EP20198/059506, mailed Jul. 20, 2021 (12 pages).
International Searching Authority, International Search Report issued in International Application No. PCT/EP2019/059506, mailed Mar. 1, 2020 (3 pages).
International Searching Authority, Search Report issued in International Application No. PCT/EP2019/063124, mailed Jul. 9, 2019 (5 pages).
Invoice from Julius Zorn GmbH to Pet Physio c/o MBE Mailboxes ect.; Rechnung 103401000360; Date: Jan. 16, 2014; 3 pages.
Notice of Opposition to European Patent EP3572570B1 with English translation; Patent Proprietor: BSN-Jobst GmbH; Opponent: Medi GmbH & Co. KG; Dated Feb. 21, 2023; 127 pages.
Notice of Opposition to European Patent EP3572570B1 with English translation; Patent Proprietor: BSN-Jobst GmbH; Opponent: Ofa Bamberg GmbH; Dated Feb. 20, 2023; 67 pages.

(56) References Cited

OTHER PUBLICATIONS

Order From Teccons eK, Reisholzstr. 39, 40721 Hilden vom; Date: Jan. 16, 2014; 3 pages.
PCT International Preliminary Report on Patentability; International Application No. PCT/EP2019/063124; International Filing Date: May 21, 2019; Date Mailed: Nov. 24, 2020; pp. 1-8.
PCT ISR Written Opinion with English Translation; International Application No. PCT/EP2019/063124; International Filing Date: May 21, 2019; Date of Mailing: Jul. 9, 2019; pp. 1-14.
Picture bundle with Pictures E20a-E20i for an EquiCrown@ compression bandage art 6600 PVK Gr. 1, Produced on Date: Jul. 11, 2013; 9 pages.
Picture bundle with the pictures E24a-E24e concerning the exhibition of a compression stocking knitted according to the program Y5249W00F at the anniversary celebration for the 55th anniversary of the company Shima Seike MFG., LTD on Nov. 16-17, 2017; 3 pages.
Picture set with pictures E26a-E26f concerning the Compression stocking knitted according to the program Y5249W00F; Date registered: Nov. 13, 2017; 5 pages.
Pictures E21a-E21h of EquiCrown compression bandage with enlarged view and designation of various relevant knitting areas; Jul. 11, 2013; 3 pages.
Proof of registration of the knitting program Y5249W00F from Nov. 13, 2017 on the user website of Shima Seike MFG., LTD for user download; Date: Nov. 13, 2017; 1 page.
Quality assurance RAL-GZ 387/1 "Medical Compression Hosiery", Jan. 2008 edition, of the German Institute for Quality Assurance and Certification; 24 pages.
Response to Notice of Opposition to European Patent EP3572570B1; In the name of BSN-Jobst GmbH; Opponent 1: Medi GmbH; Opponent 2: OFA Bamberg GmbH; Dated Jul. 11, 2023; 25 pages.
Textbook "Compression therapy"; K. Protz, 1. Dissmond, K. Kröger, Heidelberg 2016; ISBN: 978-3-662-49743-2.
U.S. Appl. No. 17/602,797, filed Oct. 11, 2021; Non-Final Office Action dated Feb. 2, 2023; 11 pages.
US Non-Final Office Action for U.S. Appl. No. 17/057,158, filed Nov. 20, 2020; Action Mailed: May 11, 2023; pp. 1-16.
AU Examination Report No. 1 for Standard Patent Application; Application No. 2019440462; Date Mailed: Mar. 15, 2024; pp. 1-3.
[Fashion Tights Bow With Seam Sheer Pantihose], posted date unknown [online], [retrieved Feb. 26, 2024]. Retrieved from internet, https://feelfab.in/products/fashion-tights-bow-with-seam-sheer-pantihose (Year: 2024); 2 pages.
[GTETKDE Women Fleece Lined Tights Fake Translucent Thermal Pantyhose], posted Sep. 22, 2022 (online), [retrieved Feb. 26, 2024]. Retrieved from internet, https://a.co/d/iaSRAFD (Year: 2022); 7 pages.
[ILENINET Thick Fleece Lined Tights Fake Translucent Tights], posted Sep. 27, 2022 [online], [retrieved Feb. 26, 2024]. Retrieved from Internet, https://a.co/d/b5IOZcl (Year: 2022); 3 pages.
[Individual 10 Back Seam Tights], posted date unknown [online], [retrieved Feb. 26, 2024]. Retrieved from internet, https:www.wolford.com/en-us/individual-10-back-seam-tights-18563.7005.html (Year: 2024); 3 pages.
[JOBST ® Elvarex® Quick Reference Brochure], revised Jul. 2011 [online], [retrieved Feb. 26, 2024]. Retrieved from internet, https://healthcaredme.com/wp-content/uploads/2019/07/Jobst-Elvarex-Details.pdf (Year: 2011); 16 pages.
[JOBSTR Elvarex® The Gold Standard In Lymphedema Garments], revised Dec. 2018 [online], Retrieved from internet Feb. 26, 2024, https://www.jobstcompressioninstitute.com/uploads/DocumentLibrary/983b04cf341c6d7614cf65f020eadd3b.pdf (Year:2018); 16 pages.
[Mivnue Fleece Lined Tights Women High Waisted Winter Warm Sheer Black Womens Thick Tights], posted Jan. 13, 2022 [online], [retrieved Feb. 26, 2024]. Retrieved from internet, https://a.co/d/afaAe73 (Year: 2022); 7 pages.
[Sheer Nude Back Seam Tights—20 den—Chiara 05], posted date unknown [online], [retrieved Feb. 26, 2024]. Retrieved from internet, https://gattawear.com/sheers/3585-sheer-nude-back-seam-tights-20-den-chiara-05.html (Year: 2024); 2 pages.
[The Essential Back Seam Sheer], posted date unknown [online], [retrieved Feb. 26, 2024]. Retrieved from internet, https://larroude.com/products/the-essential-back-seam-sheer (Year: 2024); 4 pages.
[Winter Fleece Lined Tights—Fake Translucent Fleece Winter Tights], posted Aug. 28, 2023 [online], [retrieved Feb. 26, 2024]. Retrieved from internet, https://a.co/d/4bxEbCu (Year: 2023); 5 pages.
[Wolford Horizon Back-Seam Tights], posted date unknown [online], [retrieved Feb. 26, 2024]. Retrieved from internet, https:// www.bloomingdales.com/shop/product/wolford-horizon-back-seam-tights?ID=3114324 (Year: 2024); 2 pages.
[Wolford Individual 10 Back Seam Tights For Women], posted Oct. 27, 2011 [online], [retrieved Feb. 26, 2024]. Retrieved from internet, https://a.co/d/ghzr8G8 (Year: 2011); 7 pages.
[Women's Sheer Nude Tights with back seam design], posted Apr. 5, 2019 [online]. [retrieved Feb. 26, 2024]. Retrieved from Internet, https://a.co/d/b5IOZcl (Year: 2019).
[YfiDSJFGJ 140-220LB Plus Size Warm Fleece Lined Thickened Leggings for Women], posted Oct. 6, 2021 [online]. [retrieved Feb. 26, 2024]. Retrieved from internet, https://a.co/d/cxzPEub (Year: 2021); 5 pages.
Anonymous: "FALKE Strumpfhose Family Baumwolle"; Date: Feb. 21, 2010, XP055893332, URL: https://www.amazon.de/FALKE-Babys-Strumpfhosen-Leggings-Family/dp/B005C2Z3F8/ref=sr_1_12?keywords=FALKE+Baby+Strumpfhose+offwhite&qid=1645127957&sr=8-12&th=1.
Anonymous: "JOBST Measurement Guidelines"; Date: Nov. 1, 2011, XP055893260, Retrieved from Internet: URL: https://www.lunamedical.com/wp-content/uploads/2020/10/JobstMeasurementGuidelines.pdf.
Australian Application No. 2021449207; Examination report No. 1 for standard patent application dated Dec. 5, 2023; 3 pages.
Demand under Article 31 of the Patent Cooperation Treaty and Letter Accompanying Demand for International Application No. PCT/EP2021/064951; International Filing Date: Jun. 3, 2021; Date of Mailing: Apr. 3, 2023; 20 pages.
European Application No. 21730901.2-1102; Third Party Observation dated Mar. 31, 2025; 40 pages.
International Preliminary Report on Patentability for International Application No. PCT/EP2021/064951; International Filing Date: Jun. 3, 2021; Date of Mailing: Apr. 25, 2023; 18 pages.
International Search Report & Written Opinion for International Application No. PCT/EP2021/064951; International Filing Date: Jun. 3, 2021; Date of Mailing: Mar. 4, 2022; 14 pages.
Mexican Application No. MX/a/2023/014397; Notice of Allowance dated May 27, 2024; 5 pages.
Design U.S. Appl. No. 29/817,975, filed Dec. 6, 2021; Ex Parte Quayle Action dated Mar. 11, 2024; 18 pages.
Design U.S. Appl. No. 29/817,975, filed Dec. 6, 2021; Restriction Requirement dated Dec. 27, 2023; 6 pages.
U.S. Appl. No. 18/563,230; Non-Final Office Action dated Sep. 11, 2024; 31 pages.
U.S. Appl. No. 18/563,230; Non-Final Office Action dated Jul. 10, 2025; 21 pages.

* cited by examiner

COMPRESSION ARTICLE

CROSS-REFERENCE OF RELATED APPLICATIONS

This application is a continuation-in-part of U.S. application Ser. No. 17/057,158, filed Nov. 20, 2020, and a continuation-in-part of U.S. application Ser. No. 17/602,797, filed Oct. 11, 2021. U.S. application Ser. No. 17/057,158 is a National Stage Application of PCT/EP2019/063124, filed May 21, 2019, which claims priority to European Application No. 18173788.3, filed May 23, 2018. U.S. application Ser. No. 17/602,797 is a National Stage Application of PCT/EP2019/059506, filed Apr. 12, 2019. The above-mentioned patent applications are incorporated herein by reference in their entirety.

TECHNICAL FIELD

The application relates to a compression article formed of a double-layer knitted fabric, which is produced on a knitting machine and in which respectively the number of stitches per stitch row is matched to the radial circumference of the body part to be treated by the compression article.

The application further relates to a method of manufacturing a double-layer knitted fabric, especially a compression article, on a knitting machine having at least two needle beds, wherein the knitted fabric comprises an outer layer on the first needle bed and an inner layer on the second needle bed.

BACKGROUND

In particular for the avoidance or treatment of edemas, varicose veins, veinous insufficiency, as well as after vein surgery procedures, such compression articles in the form of compression stockings, compression gloves, foot caps and the like are used. Other elastic articles include joint bandages and also burn bandages. In sport, support bandages are used to protect from injuries and partially also to enhance performance.

In the case of a double-layer knitted fabric, the outer layer can be made of a hydrophilic yarn and the inner layer can be made of a hydrophobic yarn. The inner layer then acts to move moisture away from the skin of the wearer of a garment made of such a knitted fabric. Especially compression articles and medical garments like stockings, bandages and medical soft goods that usually are worn many hours every day have to guarantee that moisture caused by perspiration is moved away from the wearer's skin to avoid discomfort or even skin irritations.

German Patent Application Publication No. DE 42 04 339 A1 for example describes such a medical knitted garment having a hydrophobic inner layer and at least one outer layer that is able to store moisture. By a capillary effect the inner layer is moving moisture from the skin to the outer layer. The hydrophobic yarn of the inner layer is floated over several needles and/or forms bows and loops on the inner surface of the garment. The disadvantage of these garments are the relatively extended areas where the outer layer made of a hydrophilic material can still touch the skin of a wearer and therefore cause discomfort by retaining the moisture close to the skin.

Another fabric according to the state of the art has an inner hydrophobic layer knitted on a first needle bed and a hydrophilic outer layer knitted on the second needle bed. However, some of the needles of the first needle bed knit the hydrophilic yarn that is used to form the outer layer. These hydrophilic stitches within the inner layer move the moisture away from the skin into the outer layer. However, also this fabric can cause discomfort because the hydrophilic stitches in the inner layer touch the skin of a wearer. And only the feet of the stitches are able to transport the moisture into the second layer what still retains a lot of moisture close to the skin.

It would be desirable to provide a method to manufacture a double layer knitted fabric having an inner hydrophobic layer and an outer hydrophilic layer capable of providing more comfort for a wearer of a garment made of such a fabric.

Knitted fabrics are favored for such elastic articles, due to the good elastic characteristics that can be achieved. These articles are primarily produced on a flat-bed knitting machine as it gives greater flexibility e.g. to adjust the shape. The article is thus produced as a flat knitted fabric, the longitudinal margins of which are subsequently sewn together, so that the desired three-dimensional article is obtained. The flat knitted fabric is knitted with more stitches per row in regions in which the body part to be treated has a larger circumference than in regions of a smaller circumference. In conventional procedures, the stitch-increases and the stitch-reductions are performed at the margins of the flat knitted fabric. This means that, after the closure of the longitudinal seam of the flat knitted fabric, this longitudinal seam has a curved path, while the opposite circumferential region of the compression article runs completely straight in the longitudinal direction. The shape of the compression article thus only imperfectly replicates the anatomy of the body part. In particular, the longitudinal axes of the compression article and of the body part do not coincide.

In patients, bulges and dimensional changes of the relevant body part are however possible at all points on the circumference. A lower leg of such a patient may not only have muscle-related circumferential widening in the calf region but also bulges in the shinbone region. The hitherto available compression articles, even given a precise measurement of the body part and a customized production of the compression article, are not sufficiently well fitting. Moreover, the currently used, above-described flat knitting technology is only partially suitable for the production of products of this type.

It would be desirable to provide compression articles having an improved fit.

SUMMARY

According to embodiments of the present invention, the technical objects identified above are achieved by a compression article which is produced from a knitted fabric created on a knitting machine, in particular a flat-bed knitting machine, and in which respectively the number of stitches per stitch row is matched to the radial circumference of the body part to be treated by the compression article, and which is characterized in that, in order to be matched in the circumferential direction to the shape of the body part to be treated, it has a plurality of points which are distributed over its circumference and at which, in a stitch row, a stitch increase and/or a stitch reduction is carried out, and in that, moreover, the number of stitches in the wale direction varies over the circumference of the compression article and the compression article is thus further matched longitudinally, to the shape of the body part to be treated.

The compression article according to the invention is distinguished by the fact that stitch increases and/or stitch reductions are realized at those points on the circumference at which the body part to be supported likewise undergoes a change in its circumference and no longer just in the region of the longitudinal seam of the article. Moreover, the fit in the longitudinal direction is improved by virtue of the fact that also the number of stitches in the wale direction of the compression article varies over the circumference thereof. Thus, according to the invention, a compression stocking, for instance, can have more stitch rows in the calf region than in the shinbone region. Hence, not only can a better fit of the compression article be obtained but also a more even distribution of the compression pressure over the body part. The three-dimensionally knitted article therefore has, in addition to an improved fit, also an improved effectiveness.

Preferably, the compression article can be knitted such that its central longitudinal axis conforms to the central longitudinal axis of the body part to be treated. Particularly uniform pressure conditions over the circumference of the body part can thereby be achieved.

Furthermore, it is an advantage if the compression article is produced as a three-dimensional flat or circular knitted fabric. As a result of stitch accumulation in a mid-region of the knitted fabric, a three-dimensional structure is formed. The compression article can, however, also be produced as a seamless tubular knitted fabric and hence acquire a three-dimensional shape. The step of subsequently sewing together the margins of the knitted fabric can then be dispensed with.

Preferably, the compression article can additionally be produced using gusseting techniques. With gusseting techniques in conjunction with stitch increase and/or stitch decrease distributed over the circumference, almost any chosen three-dimensional structures can be produced.

In a preferred embodiment, the compression article can be formed of a plurality of strip-like segments, which, in the circumferential direction of the compression article, are separated from one another by zones comprising stitch increases and/or stitch decreases.

Depending on the number of segments, compression articles in which a stitch increase and/or a stitch reduction is present at a plurality of points on the circumference are thus able to be produced in a technically relatively simple manner. The side margins of the segments can be parallel or non-parallel to one another.

Furthermore, at least some of the segments can have a different number of stitch rows or a different length of the wales (=number of stitches per wale) in order to be able to also closely match the compression article to the contour of the body part in its longitudinal direction. Preferably, the division of the knitted fabric into segments, the stitch count per stitch row in the segments and the number of stitch rows per segment can accordingly be determined from data acquired in the measurement of the body part to be supported.

Moreover, the compression article can be produced at least partially using elastic yarns, as known per se. The elastic threads can here form the ground weave of the article and/or be integrated as weft and/or warp threads.

In certain embodiments, further advantages are obtained if the compression pressure exerted on the body part by the compression article decreases from the distal end of the article toward the proximal end. This provision aids the drainage of lymph fluid toward the heart and hence promotes the excretion of excess fluid from the body.

The compression article can be produced from a double-faced or double-layered knitted fabric. The knitted fabric can be produced, for instance, from an R-R binding. Or it can have a plurality of R-L layers, which are connected to one another full-face or at certain points.

The invention additionally relates to a first method for producing a compression article on a knitting machine, in particular a flat-bed knitting machine, which method is characterized by the steps of:

- measurement of the body part to be supported by the compression article at individual measuring points;
- selection of a base pattern for the compression article from a catalogue, the measurements of which best conform to the measured body part;
- adjustment of the stitch count of the stitch rows and of the number of stitches in the individual wales of the base pattern in accordance with the measurements of the body part between the measuring points;
- knitting of the revised base pattern on a knitting machine, in particular a flat-bed knitting machine.

This method is suitable, in particular, for the production of compression articles with very good fit. It is here of advantage that the revised base pattern is produced by calculating a plurality of segments, wherein the segments are respectively separated from one another by zones in which the stitch count of the stitch rows of the knitted fabric is reduced and/or increased. The number of segments can be predefined or freely chosen.

An alternative method for producing a compression article on a knitting machine, in particular a flat-bed knitting machine, according to the invention is characterized by the steps of:

- measurement of the body part to be supported by the compression article, by scanning of the body part;
- calculation of the necessary number of stitches per stitch row in accordance with the measured circumference of the body part in that region of the body part that is covered by the stitch row;
- calculation of those points within each stitch row at which a stitch increase and/or decrease in comparison to the preceding stitch row is necessary, so that the central longitudinal axis of the compression knitted fabric conforms to the central longitudinal axis of the body part;
- calculation of the necessary number of stitches per wale of the compression article for covering the body part in the longitudinal direction thereof;
- knitting of the compression article on a flat-bed knitting machine, using the calculated stitch counts per stitch row, the calculated points of a stitch increase and/or decrease in the stitch rows, and the calculated necessary numbers of stitches per wale.

This method requires the full scanning of the body part to be supported. From this measurement data, the necessary stitch count and/or gusset points for the optimal fit of the compression article are then calculated row by row. A stitch increase or a stitch reduction can now be provided at each point within a stitch row, not just at the margins of segments. This more complex method is, in particular, suitable for the production of compression articles for patients having complaints for which a perfect fit and an optimal compression pressure distribution are essential.

According to other embodiments of the present invention, the technical objects identified above may be achieved by a method of manufacturing a double-layer knitted fabric in accordance with one embodiment of the invention, especially a compression article, on a knitting machine having at least two needle beds, wherein the knitted fabric comprises an outer layer made of a hydrophilic yarn on the first needle bed and an inner layer made of a hydrophobic yarn on the second needle bed, wherein stitches with the hydrophilic yarn are also knitted on selected needles of the second needle bed, that is characterized by comprising the steps of and carried out in the following order:

a. Forming of stitches with a hydrophilic yarn material with all needles of the first needle beds and with selected needles of the second needle bed;
b. Transferring the stitches made of the hydrophilic yarn material and formed on the selected needles of the second needle bed to needles of the first needle bed;
c. immediately after transferring the stitches in step b. forming of stitches with a hydrophobic yarn material on the selected needles of the second needle bed (=split-stitches) as well as with all other needles of the second needle bed.

By splitting the stitches originally formed on selected needles of the second needle bed and knitted by a hydrophilic yarn the heads of these stitches are incorporated in the outer layer after the transfer of these stitches in step b and replacing them on the second needle bed by hydrophobic stitches. Only the legs and feet of each of these split stitches are part of the inner layer touching the skin of a wearer of a garment made of such a fabric. Therefore, less moisture is retained in the inner layer close to the wearer's skin. On the other hand, not only the feet of these stitches but also the legs are able to move moisture away from the skin into the outer layer. Thus, the push and pull effect on the skin moisture is considerably better than in fabrics according to the state of the art. The wearer of such a garment feels dry and comfortable.

Further benefits can be obtained if before the transfer of stitches in step b. an inlay thread is laid onto the stitches made of hydrophilic yarn and extending between the two needle beds.

Inlay threads are frequently used in compression articles to provide the desired compression on the wearer's body part. By inserting these threads before the stitch transfer in step b. the threads can be fixed in the fabric by the transferred stitches.

The inlay threads are usually elastic threads especially if the fabric is a compression article. They can also be hydrophobic threads or have a hydrophobic coating. It is also common to use inlay threads having an elastic core that is covered by a hydrophobic fiber material.

In order to fix the inlay threads safely in the fabric it is advantageous if in step b. the stitches from selected needles of the second needle bed are transferred to needles of the first needle bed that are laterally offset with regard to the selected needles of the second needle bed. In this way, the stitches transferred in step b. are wrapped around the inlay thread and fix it securely.

In a preferred embodiment of the method of the invention in step a. stitches are formed with a hydrophilic yarn on every second needle of the second needle bed. Thus, every second stitch in a course on the second needle bed is a split stitch that is capable of moving moisture away from the skin. However, these stitches can also be formed further spaced apart from each other depending on the use of the fabric.

It is also possible to knit one or more courses with a hydrophilic yarn on all needles of the first needle bed after step a, i.e. before transferring back the stitches on selected needles of the second needle bed to needles of the first needle bed in step b. Thus, courses with split stitches are spaced further apart from each other.

In order to knit a whole garment or larger areas of the fabric having good moisture discharging properties steps a. to c. are repeated several times wherein each time in step a. the stitches on selected needles of the second needle bed are formed on different needles than in the preceding execution of step a. Thus, the split stitches are distributed evenly over the fabric.

It is further preferable that a moisture transporting and/or an elastic yarn is used as a hydrophilic yarn. If the hydrophilic yarn has capillaries moisture can easily be moved away from the skin. Especially for a compression article it is also advantageous if the hydrophilic yarn is elastic. For the same reason, also the hydrophobic yarn can be an elastic yarn.

Further embodiments of the invention relate to a double layer knitted fabric, in particular a compression article, comprising an outer layer made of a hydrophilic yarn and an inner layer made of a hydrophobic yarn and manufactured by a method according to the invention and characterized in that the inner layer of the fabric has spaced apart split stitches made of a hydrophilic yarn.

BRIEF DESCRIPTION OF THE DRAWINGS

The features and advantages of the invention will be appreciated upon reference to the following drawings. The accompanying drawings, which are incorporated in and constitute a part of this specification, illustrate one or more embodiments of the invention and, together with the general description given above and the detailed description given below, explain the one or more embodiments of the invention.

DETAILED DESCRIPTION

Figure 1:
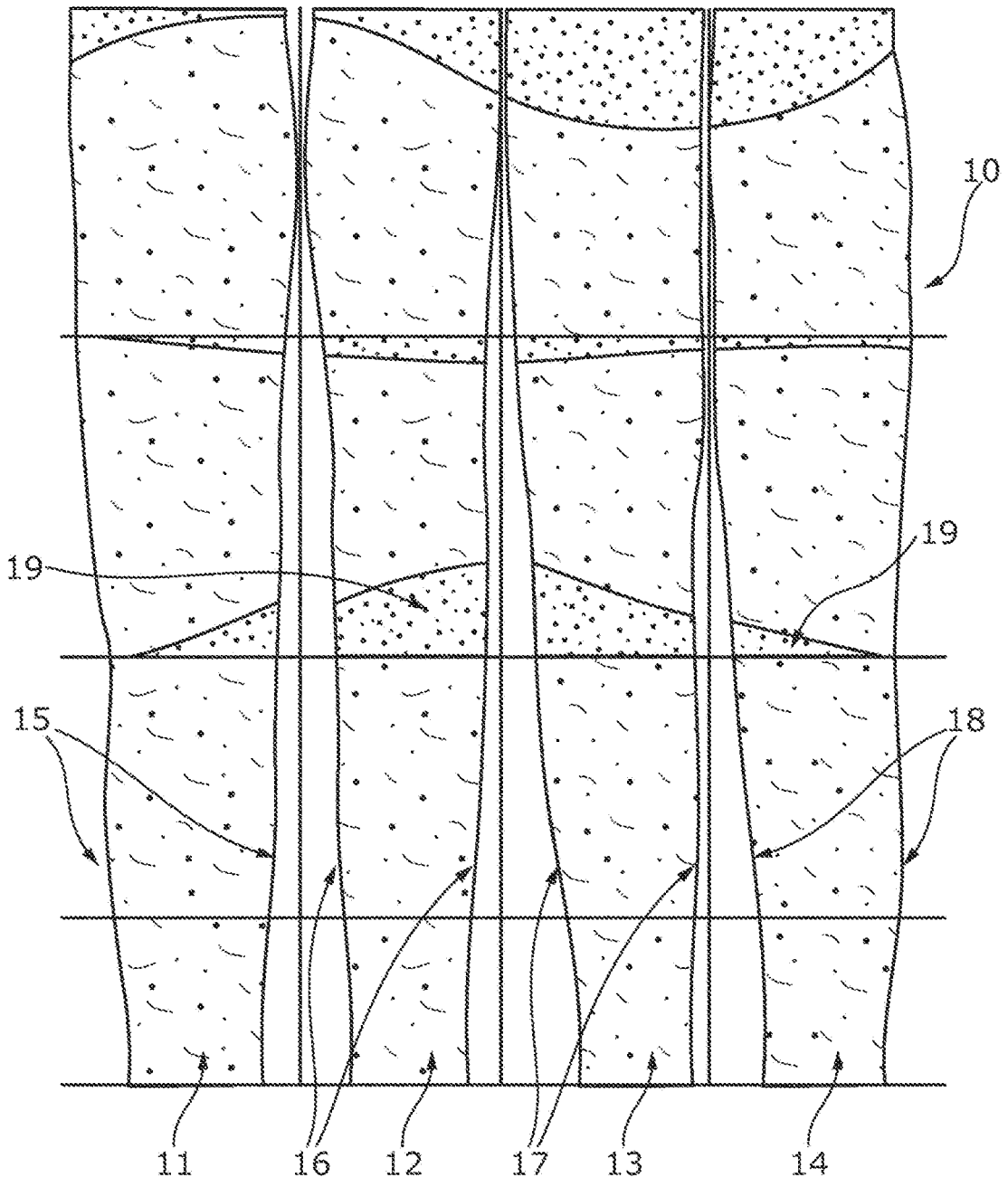
FIG. 1 shows a top view of segments of a base pattern for a compression article.
Figure 2:
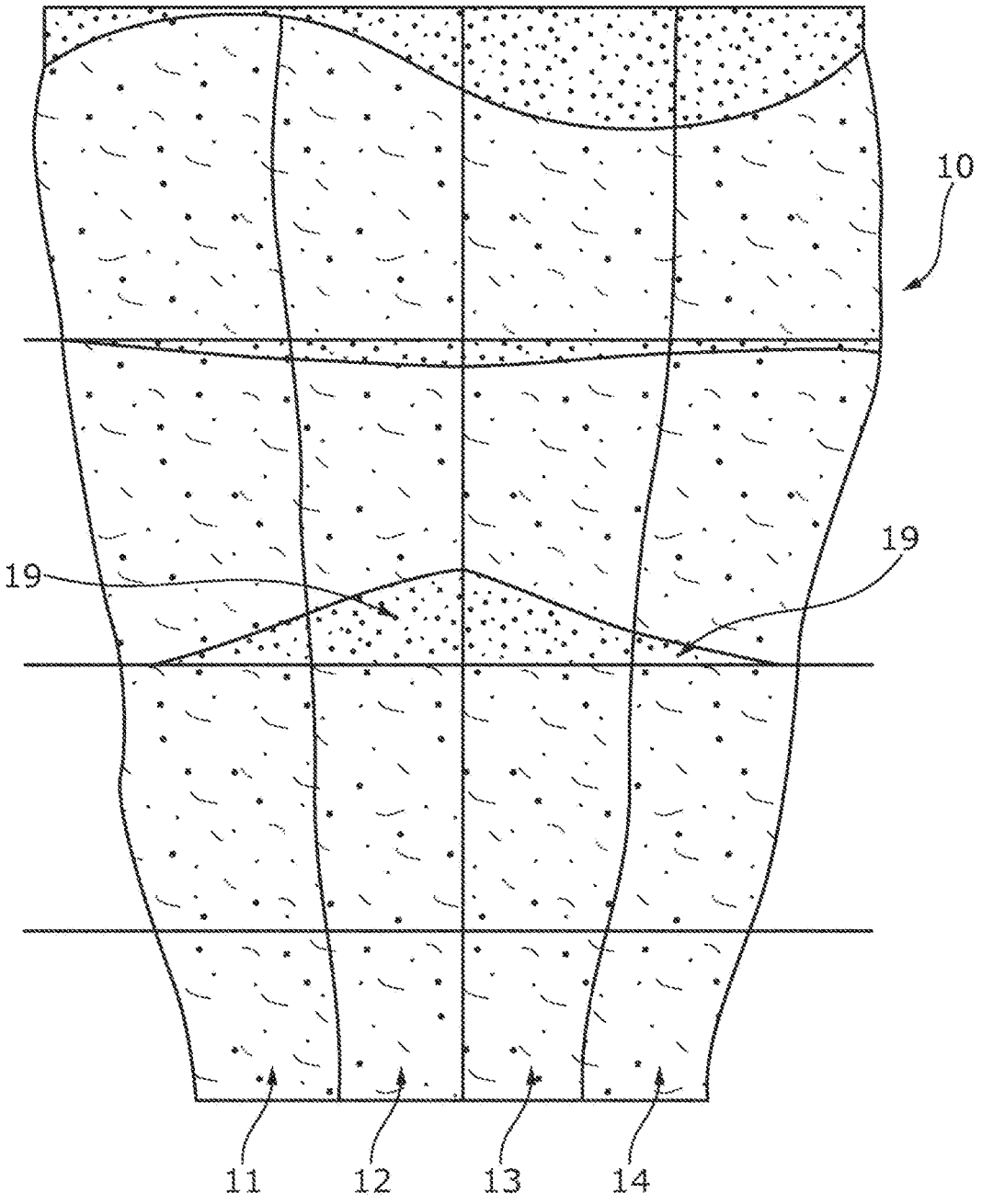
FIG. 2 shows the compression article from FIG. 1 after completion on a flat-bed knitting machine.

In the illustrated example, the compression article 10 shown in FIGS. 1 and 2 is produced on a flat-bed knitting machine and is divided in the design stage into four segments 11, 12, 13 and 14, which between them define zones 15-18 in which a stitch increase and/or a stitch reduction is carried out. The four segments 11 to 14 are knitted with common thread guides, so that the finished knitted fabric shown in FIG. 2 is obtained. The representation in FIG. 1 serves, however, to better illustrate the production method for the article 10.

Each of the segments 11 to 14 is adapted in the zones 15 to 18 at the longitudinal margins of the segments 11 to 14 with respect to the stitch count in each stitch row such that the finished knitted compression article 10 is optimally matched in its shape to a body part to be supported. To this end, measurement data of the body part is first used to select a base pattern for the compression article 10 from a set of available patterns which already approximates to the required shape of the compression article 10. The patterns of the segments 11 to 14 of this base pattern are subsequently revised such that the fit of the compression article 10 composed of the segments is optimally matched to the shape of the body part. This revision is made by adapting the stitch count per stitch row in the zones 15 to 18 at the longitudinal margins of the segments 11 to 14 and by providing gusseting zones 19 at least in some of the segments 11 to 14. Also the length of the wales of the segments 11 to 14 is varied in accordance with the body part shape. There is thus formed the three-dimensional compression article 10 shown in FIG. 2, which has merely to be closed by a longitudinal seam.

Figure 3:
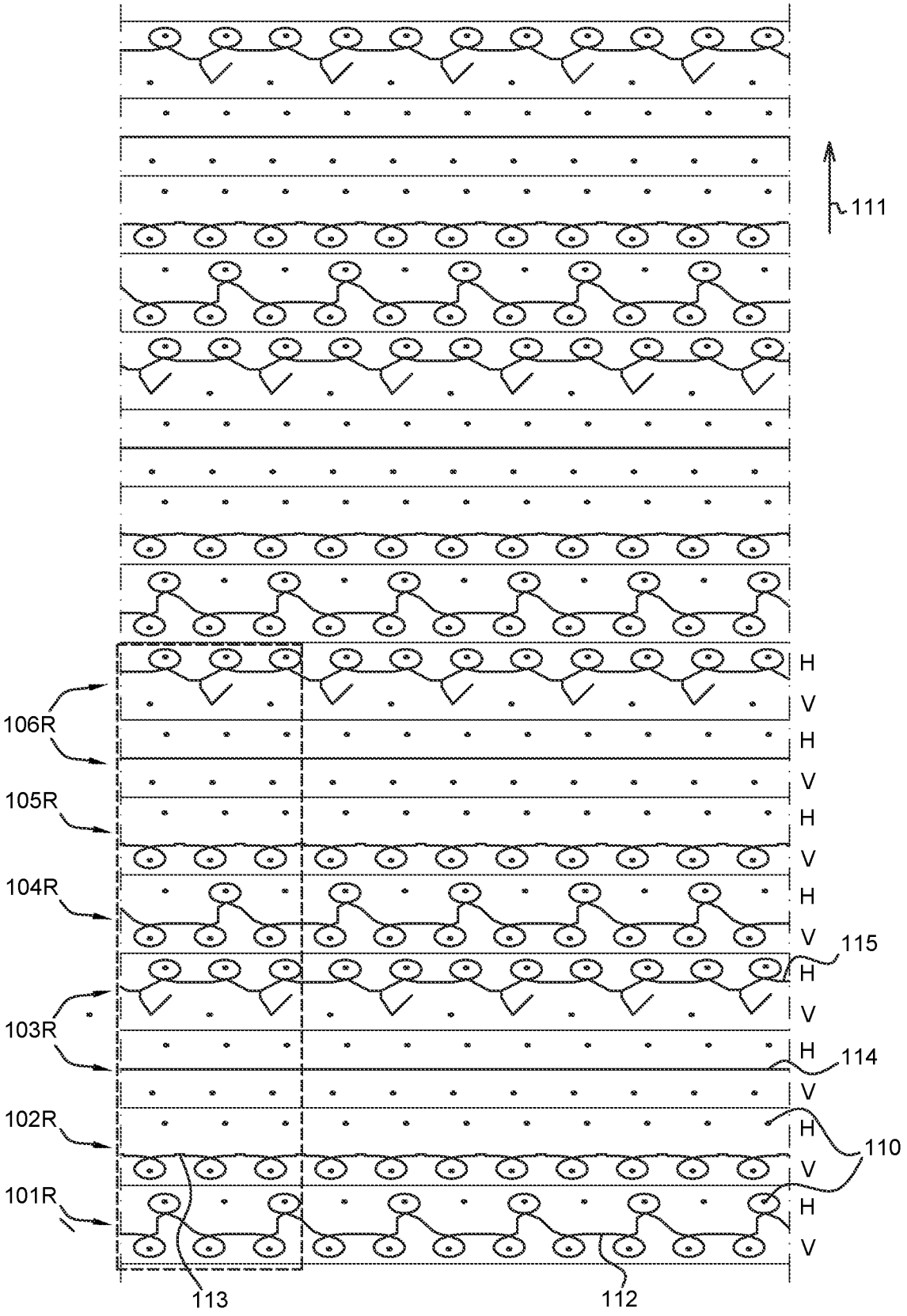
FIG. 3 shows a knitting process diagram for a section of a fabric, in accordance with one embodiment of the present invention.

The diagram of FIG. 3 shows a sequence of courses knitted on a front needle bed V and a rear needle bed H of a flat knitting machine wherein the needles of these needle beds V, H are marked by dots 110. The knitting direction is indicated by an arrow 111.

In a first course 101R stitches are knitted with a hydrophilic yarn 112 on all needles of the front needle bed V and on every second needle of the rear needle bed. On the front needle bed V an outer hydrophilic layer of the fabric is knitted and on the rear needle bed an inner and hydrophobic layer. In a second course 102R stitches are knitted with a second hydrophilic yarn 113 on all needles of the front needle bed V. This course 2R is optional. Instead of a different yarn 113 again yarn 112 could be used to knit this course 102R.

In a third course 103R that is pictured as two separate courses just for reasons of clarity an inlay thread 114 is laid between the stitches formed in the previous courses 101R and 102R on the front and rear needle bed V, H. Immediately after placing the inlay thread 114 the stitches of the rear needle bed H formed in course 101R are transferred to the opposite needles of the front needle bed V and on all needles on the rear needle bed H stitches are formed with a hydrophobic yarn 115. The transferred stitches or split stitches fix the inlay thread 114 in the fabric. Their feet are still on the rear needle bed H and therefore part of the inner hydrophobic layer of the fabric. Thus, these stitches are able to move moisture from the inner layer to the outer layer of the fabric.

The courses 104R to 106R are a repetition of courses 101R to 103R with the one difference that in course 104R stitches are formed with the hydrophilic yarn 112 on needles of the rear needle bed that have not formed stitches with that yarn 112 in course 101R. In further repetitions of courses 101R to 103R the knitting of these stitches on the rear needle bed H always alters between odd and even needles of the rear needle bed. Thus, the split stitches can be uniformly distributed over the surface of the inner layer of the fabric.

It is also possible to knit only on every third needle of the rear needle bed H in course R1 with yarn 112. In further repetitions of course R1 each time the first needle on which a stitch with yarn 112 is formed is moved by one to the right in order to achieve a uniform distribution of the split stitches.

Figure 4:
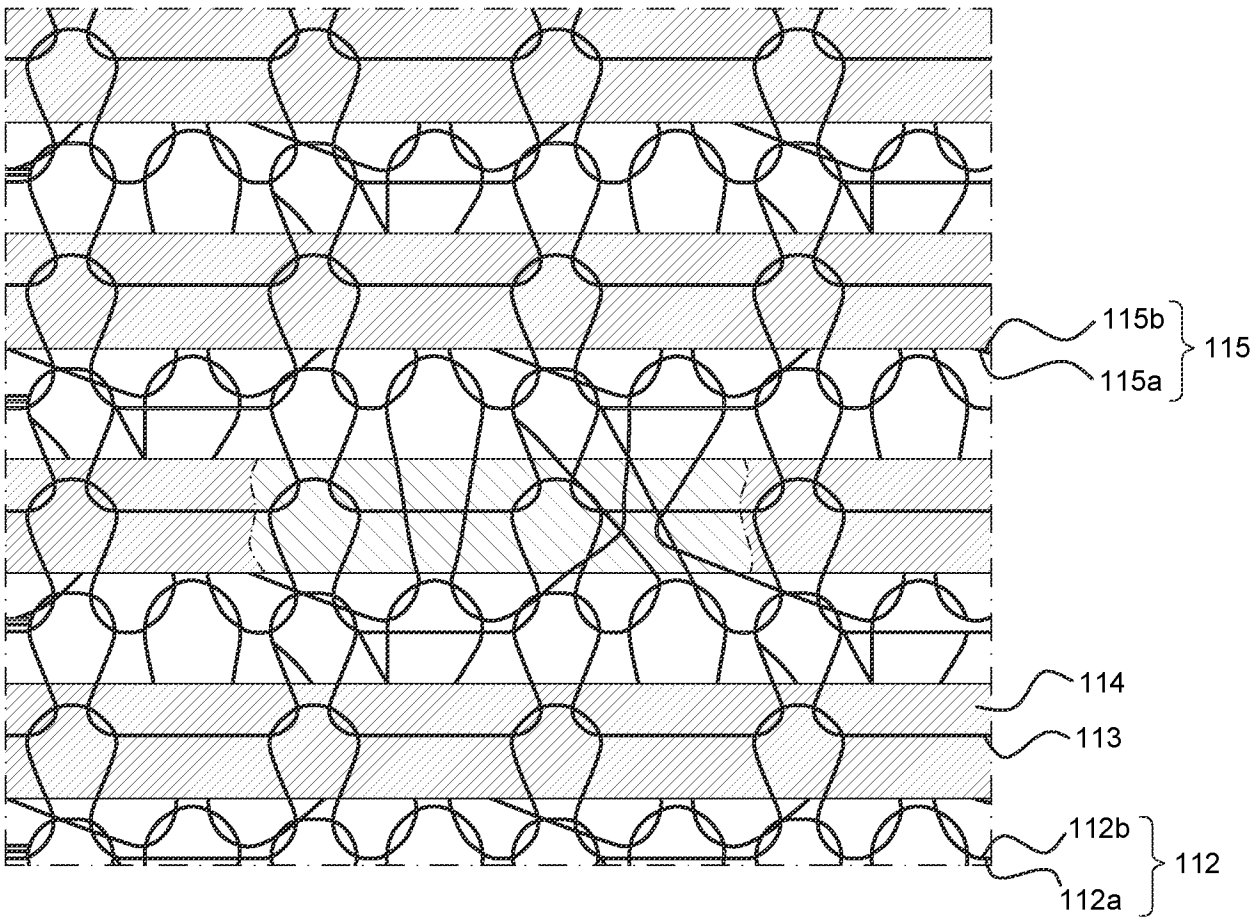
FIG. 4 shows a portion of a double layer knitted fabric that may be made by the method of embodiments of the present invention.

The stitch pattern picture of a double layer knitted fabric in FIG. 4 shows a view onto the outer layer formed by hydrophilic yarns 112, 113 wherein the yarn 112 is formed by two yarns 112*a*, 112*b*. The inner layer is formed by stitches made of hydrophobic yarns 115*a*, 115*b*. Also, elastic inlay threads 114 are hydrophobic. In the center portion of FIG. 4 the inlay thread 114 is omitted and a split stitch formed by hydrophilic yarns 112 can be seen. Its feet are part of the inner layer while its head and legs are part of the outer layer. Thus, moisture can be moved from the inside of the fabric to the outer layer.

The embodiments described above are descriptions of preferred embodiments of the present invention, and are not intended to limit the scope of the present invention. Various variations and modifications can be made by those of ordinary skill in the art, without departing from the design and scope of the present invention. The variations and modifications should all fall within the claimed scope defined by the claims of the present invention.

The invention claimed is:

1. A compression article comprising a knitted fabric having stitch rows and wales, produced on a knitting machine having at least two needle beds, in which a number of stitches per stitch row is matched to a circumference of a body part to be treated by the compression article wherein, in order to match in a circumferential direction the shape of the body part to be treated, the compression article has a plurality of points which are distributed over its circumference at which, in a stitch row, a stitch increase or a stitch reduction is realized, wherein the fabric is a double-layered fabric comprising an outer layer formed of a first yarn and an inner layer formed of a second yarn and the inner layer of the fabric has spaced apart split stitches made of the first yarn.

2. The compression article as claimed in claim 1, wherein a central longitudinal axis of the article conforms to a central longitudinal axis of the body part to be treated.

3. The compression article as claimed in claim 2, wherein the fabric is flat knitted and closed at a longitudinal seam to form the compression article.

4. The compression article as claimed in claim 1, comprising a variation in a number of stitches in a wale direction around a circumference of the compression article whereby the compression article is matched, in a longitudinal direction of the body part, to the shape of the body part to be treated.

5. The compression article as claimed in claim 4, wherein the variation in a number of stitches in the wale direction comprises a gusset.

6. The compression article as claimed in claim 1, wherein the stitch increases and stitch reductions are located in a plurality of zones that are separated from each other by strip-shaped segments.

7. The compression article as claimed in claim 6, wherein at least some of the segments have a different number of stitch rows.

8. The compression article as claimed in claim 1, wherein the first yarn is a hydrophilic yarn and the second yarn is a hydrophobic yarn.

9. The compression article as claimed in claim 1, further comprising elastic inlay yarns extending between the inner layer and the outer layer.

10. The compression article as claimed in claim 9, wherein the elastic inlay yarns are hydrophobic or are covered with a hydrophobic material.

11. The compression article as claimed in claim 9, wherein the split stitches are wrapped around the elastic inlay yarn to fix it securely between the layers.

12. The compression article as claimed in claim 1, wherein the split stitches are distributed evenly over the fabric.

13. The compression article as claimed in claim 1, wherein heads of the split stitches are incorporated in the outer layer and legs and feet of the split stitches are integrated into the inner layer such that they contact the body part.

14. A compression article formed from a double layer knitted fabric for application to a body part to be treated, the fabric comprising an outer layer of hydrophilic yarn and an inner layer of hydrophobic yarn and having rows of stitches extending in a circumferential direction of the body part, wherein a number of stitches per stitch row is matched to a circumference of the body part and the compression article has a plurality of points which are distributed over its circumference at which, in a row, a stitch increase or a stitch reduction relative to an adjacent row is realized.

15. The compression article as claimed in claim 14, wherein the stitch increases and stitch reductions are located in a plurality of longitudinally extending zones that are separated from each other by strip-shaped segments in which no such stitch increase or stitch reduction is present.

16. The compression article as claimed in claim 14, comprising wales extending in a longitudinal direction of the article and a variation in a number of stitches in a wale varies around the circumference of the compression article whereby the compression article is matched, in a longitudinal direction of the body part, to the shape of the body part.

17. The compression article of claim 14, comprising uniformly distributed split stitches that join the inner layer to the outer layer.

18. A method for producing a compression article on a knitting machine, comprising:

measuring the body part to be supported by the compression article by scanning of the body part or by measurement at individual measuring points;

calculating a necessary number of stitches per stitch row in accordance with the measured circumference of the body part in that region of the body part that is covered by the stitch row;

calculating points within each stitch row at which a stitch increase or decrease in comparison to the preceding stitch row is necessary, so that a central longitudinal axis of the compression knitted article conforms to a central longitudinal axis of the body part;

knitting the compression article on a knitting machine having at least two needle beds, using the calculated stitch counts per stitch row and the calculated points of a stitch increase or decrease in the stitch rows wherein the compression article has a plurality of layers, which are connected to one another at certain points.

19. The method of claim 18, wherein knitting the compression article comprises:

a. Forming of stitches with a first yarn with all needles of the first needle bed and with selected needles of the second needle bed;

b. transferring the stitches of the first yarn formed on the selected needles of the second needle bed to needles of the first needle bed;

c. immediately after transferring the stitches in step b. forming of stitches with a second yarn on the selected needles of the second needle bed as well as with all other needles of the second needle bed.

20. The method as claimed in claim 19, wherein the first yarn is a hydrophilic yarn and the second yarn is a hydrophobic yarn.

* * * * *